United States Patent [19]

Russell et al.

[11] Patent Number: 4,819,641

[45] Date of Patent: Apr. 11, 1989

[54] SANITARY BABY PACIFIER

[76] Inventors: Joseph W. Russell; Toni M. Russell, both of 8018 2nd Ave., Inglewood, Calif. 90302

[21] Appl. No.: 115,448

[22] Filed: Oct. 30, 1987

[51] Int. Cl.[4] ..... A61J 17/00

[52] U.S. Cl. ..... 128/360; 128/359; 215/11.3

[58] Field of Search ..... 604/75, 76, 77; 128/359, 360, 136, 150, 330; 215/11 R, 11.1–11.6

[56] References Cited

U.S. PATENT DOCUMENTS

| | | | |
|---|---|---|---|
| 2,780,378 | 2/1957 | Romano | 215/11.1 |
| 2,825,335 | 3/1958 | Natonek | 128/360 |
| 3,129,709 | 4/1964 | Rountree | 128/360 |
| 3,143,429 | 8/1964 | Swanson et al. | 215/11.3 |
| 3,363,630 | 5/1965 | Hines | 128/360 |

*Primary Examiner*—Stephen C. Pellegrino
*Assistant Examiner*—Colleen M. Reilly
*Attorney, Agent, or Firm*—Erik M. Arnhem

[57] ABSTRACT

A baby pacifier comprises a pair of opposed generally dome shaped members coupled by a collapsable wall portion. An upwardly extending nipple member is supported within one of the domed members. The remaining domed member defines a slot through which the nipple member may be passed. A pair of handle sections are coupled between the dome and are operative to drawn the dome sections together and expose the nipple member.

7 Claims, 2 Drawing Sheets

SANITARY BABY PACIFIER

FIELD OF THE INVENTION

The present invention is related generally to an improved baby pacifier or soother, and more particularly to a baby pacifier having integral nipple encasing and shielding capabilities.

BACKGROUND OF THE INVENTION

Through the years a number of pacifier devices have been developed for use in providing a soothing member for use by a human infant. While the specific structure of baby pacifiers developed have taken many forms, all may generally be said to include an elongated soft resilient member generally terminating in a bulbous end which is sized and adapted to be received within the infants mouth. The soothing action arises from the nursing or sucking action of the infant upon this extended resilient member. For purposes of safety, such pacifiers also generally include a rather enlarged base portion at the remote end of the resilient member which is of sufficient size to be too large for the infant to draw into its mouth. In most structures, the side of the planar or base member supports a handle of some sort configured to be readily grasped by an infants hand.

In their normal use, such pacifiers are of course moistened by the infant and repeatedly removed from the infants mouth and returned for continued pacification. In addition, a sweet substance, such as jelly or honey, is often coated upon the resilient portion of the pacifier by mothers seeking to enhance the infants use of the pacifier.

In many instances, those caring for infants will need to remove the pacifier from the infants use for some prolonged period of time. During these periods of nonuse, it is often difficult to readily carry, transport or store the pacifier due to the moisture applied to the pacifier by the infants mouth. In addition, it is desirable to maintain or store the pacifier in a manner which avoids subjecting it to dirt, germs or other contaminants. In the typical environment in which such pacifiers are used, this maintenance of sanitation and cleanliness is often difficult to achieve.

These problems have caused practitioners in the art to develop various pacifiers which provide some improved cleanliness and transportability.

One is U.S. Pat. No. 3,363,630 issued Jan. 16, 1968 to Charles F. Hines discloses a collapsible shield for a baby pacifier which has a nipple which can be introduced with one end into the mouth of a baby, while the other end of the nipple defines a base for handling. The shield member is of conical configuration and the smaller end thereof can be attached to the base end of the nipple. When the nipple is introduced into the mouth of the baby, the shield collapses in the direction of its smaller end.

U.S. Pat. No. 3,129,709 issued Apr. 21, 1964 to Joseph D. Roundtree sets forth a baby pacifier slidably disposed in a sleeve which can be moved between positions of extension for use and retraction for storage by a turning knob.

U.S. Pat. No. 2,860,639 issued Nov. 18, 1958 to Frank M. Hoover is concerned with a pacifier and shield assembly, wherein the shield comprises a conical member with an annular curving flange. The flange defines a plurality of circumferentially spaced slits. The shield can be removably positioned in registry over the peripheral edge of the disc which is mounted over the nipple which, in turn, is mounted on the head portion of the unit.

U.S. Pat. No. 2,825,335 issued Mar. 4, 1958 to R. Natonek sets forth a rattled rubber soother having at least one hollow member for receiving pellets which can make the rattling noise.

While such prior art structures provide some improvement over standard pacifiers, there remains, however, the need for an improved and effectively shielded baby soother or pacifier.

SUMMARY OF THE INVENTION

It is a general object of the present invention to provide an improved baby pacifier. It is a more particular object of the present invention to provide an improved baby pacifier which may be safely and sanitarily transported and stored.

In accordance with the invention there is provided a baby pacifier comprising a concave base member supporting an upwardly extending nipple member defining a nipple stem secured to the center of the base member and extending upwardly therefrom and terminating in a rounded nipple end. A concave top member is formed of a resilient material and defines a centrally located elongated slot and a collapsable side wall extending downwardly to and secured to the base member. The base member and top member form an enclosure for the nipple member. A pair of handle members extend through the base member and are secured to the interior of the top member on opposite sides of the elongated slot. The handle members may be drawn through the base member causing the top member to collapse and conform to the base member and causing the nipple member to extend through the elongated slot to an exposed or open position.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 6 is a bottom perspective view of an alternate embodiment of the present invention baby pacifier; and FIG. 7 is a section view of the embodiment of FIG. 6 taken along section lines 7—7 in FIG. 6.

DESCRIPTION OF THE PREFERRED EMBODIMENT

Figure 1:
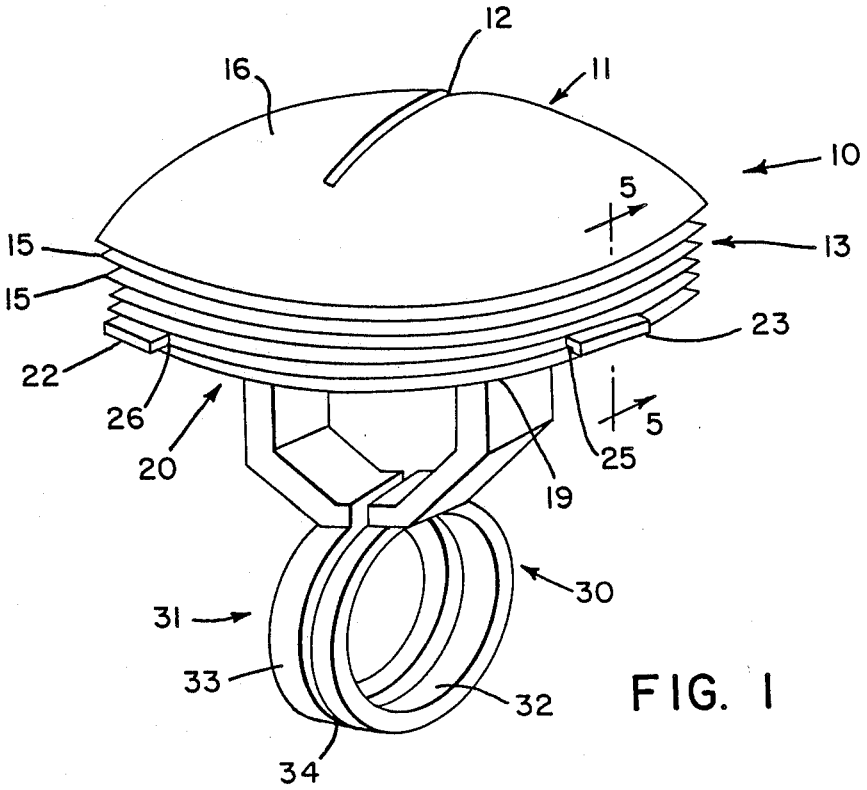
FIG. 1 is a perspective view of the present invention baby pacifier in the closed position.

FIG. 1 sets forth a perspective view of a baby pacifier constructed in accordance with the present invention. The view in FIG. 1 sets forth the present invention baby pacifier in the closed position in which the nipple member is protected within the pacifier. Accordingly, the present invention pacifier generally referenced by numeral 10 includes a concave top member 12 formed of a resilient elastic material and defining a generally domed or spherical portion 16 which in turn defines an elongated longitudinal slot 12. Top 11 further defines a downwardly extending collapsalbe side wall 13. In accordance with an important aspect of the present invention, side wall 13 further defines a plurality of circular side ribs 15 which, as set forth below in greater detail, form a collapsable accordion structure. Side walls 13 terminate in a downwardly facing edge 14 and further define a trio of equally spaced slots 25, 26 and 27 (slot 27 better seen in FIG. 2).

A generally convex base member 20 defines a domed-shaped member 19 which terminates in a circular edge 21. A pair of handle sections 30 and 31 extend through base member 20 and by means shown below, attach to the interior of spherical portion 16. Handle sections 30 and 31 further define a pair of finger ring members 32 and 33 respectively. Ring members 32 and 33 are joined at seam 34.

Figure 2:
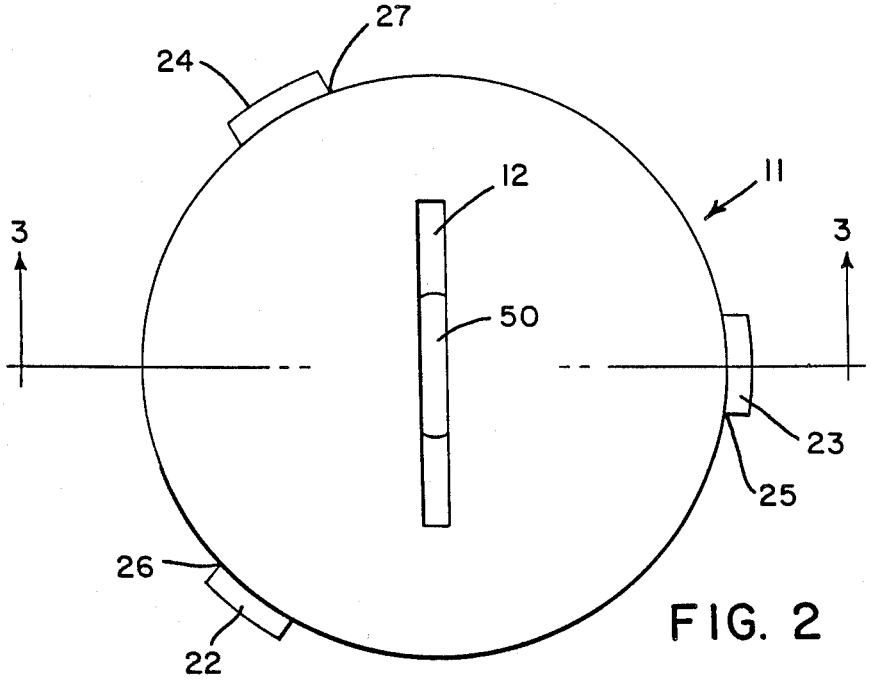
FIG. 2 is a top view of the present invention baby pacifier in the closed position.

FIG. 2 sets forth a top view of the present invention baby pacifier in the closed position shown in FIG. 1. As can be seen, top 11 forms a generally circular dome-shaped member having an elongated slot 12 extending laterally across its center portion. A trio of outwardly extending tabs 22, 23 and 24 are equally spaced about the perimeter of base member 20 (seen in FIG. 1) and extend beyond top 11. As is set forth below in greater detail, top 11 further defines a corresponding plurality of slots 26, 25 and 27 through which tabs 22, 23 and 24 respectively extend through. As can also be seen in FIG. 2 and as is set forth below in greater detail, a nipple member 50 is positioned directly beneath slot 12 in the closed position shown in FIGS. 1 and 2. In accordance with an important aspect of the present invention and as is shown below in FIG. 4, nipple member 50 extends through slot 12 when the present invention baby pacifier is configured in the open position shown in FIG. 4 and described below in greater detail.

Figure 3:
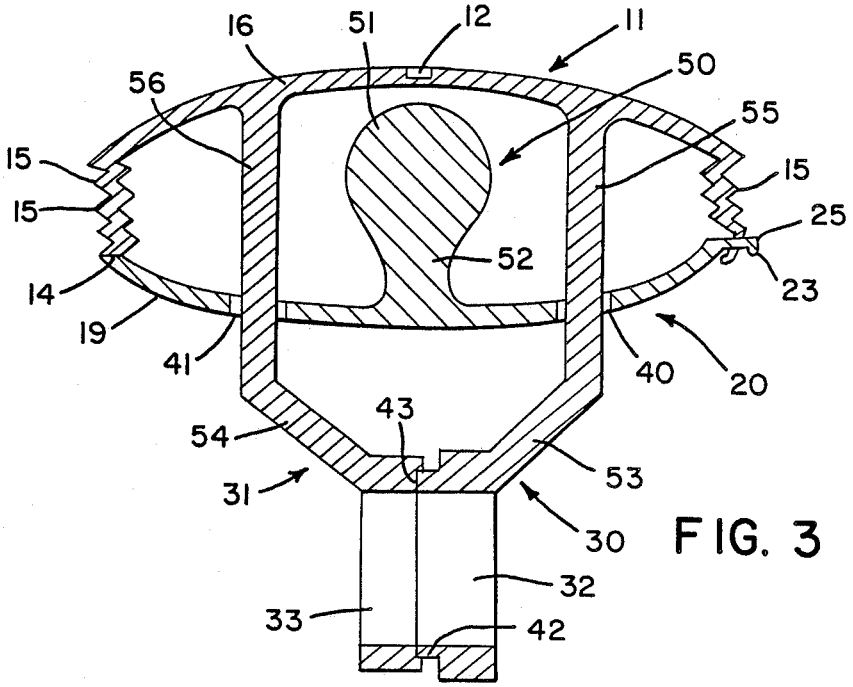
FIG. 3 is a section view of the present invention baby pacifier taken along section lines 3—3 in FIG. 1.

FIG. 3 sets forth a section view of the present invention baby pacifier taken along section lines 3—3 in FIG. 1. As set forth above, the present invention baby pacifier is shown in FIGS. 1, 2 and 3 in the closed position. With respect to FIG. 3, top member 11 defines a generally domed or spherical portion 16 which further defines an elongated slot 12. A downwardly extending side wall 13 terminates in an edge 14 and as set forth above, defines a plurality of slots 25 through 27. (Slots 26 and 27 seen in FIG. 2). Base member 20 defines a domed member 19 terminating in an upper edge 21 and defining a pair of slots 40 and 41. A nipple member 50 is formed of a resilient material and comprises a generally rounded nipple end 51 and a generally cylindrical nipple stem 52. In accordance with the invention, nipple stem 52 is joined to the interior of base 20 and extends upwardly therefrom. In further accordance with the present invention nipple member 50 is positioned beneath the center of elongated slot 12. A pair of handle sections 30 and 31 define respective generally annular finger rings 32 and 33. In accordance with an important aspect of the present invention, finger ring 33 defines a recessed snap well 43 while finger ring 32 defines an inwardly extending generally cylindrical snap projection 42. Snap projection 42 is sized and configured to fit tightly within snap well 43 and provide a snap attachment between finger rings 32 and 33. Handle 30 defines a pair of arms 53 and 55 which extend upwardly from finger ring 32. Arm 55 extends through slot 40 and is attached or joined to the interior of domed portion 16. Correspondingly, handle section 31 defines a pair of arms 54 and 56 which extend upwardly from finger ring 33. Arm 56 extends through slot 41 in base 20 and is joined or attached to the interior of domed member 16. In the configuration shown, top member 11 is secured to base member 20 by the cooperation of tabs 22, 23 and 24 and slots 26, 25 and 27 respectively.

Figure 4:
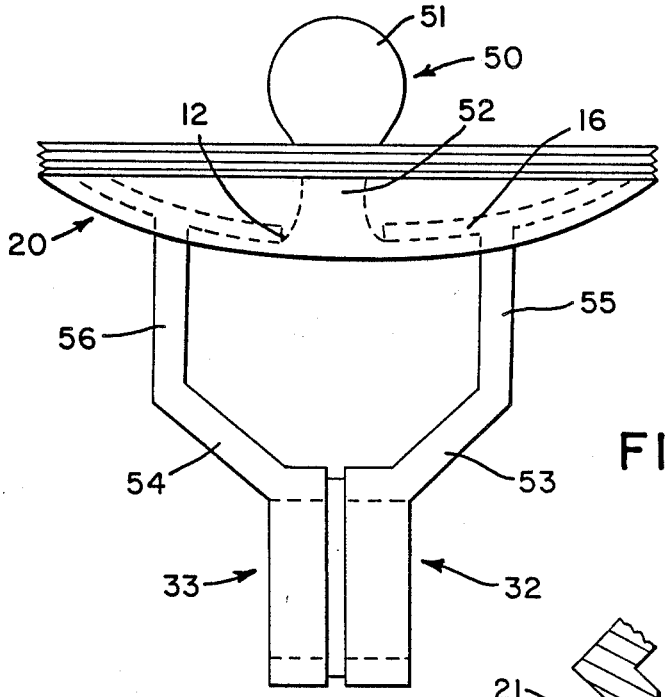
FIG. 4 is a side view of the present invention baby pacifier with the nipple in the fully extended position.

In accordance with an important aspect of the present invention, top 11 may be collapsed and drawn downwardly against base member 20 by drawing handle sections 30 and 31 downwardly through slots 40 and 41 to the position shown in FIG. 4. With the downward motion of handle sections 30 and 31, spherical portion 16 is drawn downwardly against base member 20. As spherical member 16 is drawn downwardly, nipple member 50 is forced through slot 12 which in turn causes slot 12 to deform and permit nipple member 50 to pass through slot 12 and emerge beyond top 11. With continued downward drawing of the handle sections 30 and 31, side walls 13 of top 11 collapse and spherical portion 16 conforms to the interior surface of base member 20.

FIG. 4 sets forth the present invention baby pacifier configured in the open position in which spherical portion 16 of top 11 has been drawn downwardly against base member 20. In the position shown, handle sections 32 and 33 have been drawn through base 20. As described above, side wall 13 has been compressed by the drawing of handle sections 32 and 33 and nipple member 50 extends through slot 12 in spherical portion 16 and extends beyond top 11. As can be seen in FIG. 4, the exposure of nipple member 50 permits the infant to utilize the present invention pacifier in its normal manner. In addition, the present invention pacifier in the open position of FIG. 4 may be handled by the convenient handle formed by the snapped assembly of handle sections 32 and 33. As a result of forcing handle sections 32 and 33 upwardly, spherical section 16 is forced upwardly and slot 12 therein is passed about nipple stem 52 and rounded end 51 of nipple member 50. The continued upward motion of handle sections 32 and 33 reconfigures the present invention baby pacifier in the closed position shown in FIG. 1 and slot 12 due to the resilience of top 11, returns to the elongated slot configuration shown in FIG. 1. As a result, the present invention pacifier completely encloses nipple member 50 in a protective environment which maintains the sanitation thereof.

The present invention pacifier may be returned from the open position shown in FIG. 4 to the closed position shown in FIG. 1 by reversing the above-described process and forcing handle sections 32 and 33 upwardly with respect to base 20.

Figure 5:
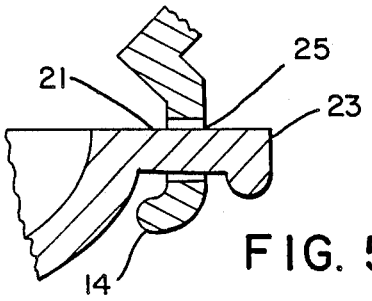
FIG. 5 is a partial section view of an attachment tab of the present invention baby pacifier.

FIG. 5 sets forth a detail partial section view of tab 23 and slot 25. It should be understood that the structure of tab 22 and slot 26 as well as tab 24 and slot 27 are identical to tab 23 and slot 25. As can be seen in FIG. 5, tab 23 in base member 20 extends through slot 25 and captivates top 11 with respect to base member 20. In accordance with an important aspect of the present invention, top 11 may be completely removed from base 20 by pasisng slots 24, 25 and 26 over their respective tabs whereby top 11 may be completely removed from the present invention pacifier by unsnapping handle sections 32 and 33 and drawing them through slots 40 and 41. As a result, the entire pacifier may be disassembled for easy cleaning and reassembled using the reverse of the above-described disassembly procedure.

FIG. 6 sets forth a bottom perspective view of an alternate embodiment of the present invention baby pacifier. A pair of handle sections 71 and 72 are constructed in accordance with and identical to handle sections 31 and 32 of the embodiment shown in FIGS. 1 through 5. In further similarity to the embodiment of FIGS. 1 through 5, the embodiment of FIG. 6 defines a domed base member 70 and a spherical top portion 73. Top portion 73 is identical to spherical portion 16 in the prior embodiment and accordingly defines an accordian wall section 74 which extends to and meets base member 70 in further similarity to the above-described embodiment. It should be understood that the embodiment of FIG. 6 defines the same internal construction having a nipple member (not shown) identical to nipple member 50 which cooperates with a similar slot (not shown) to slot 12 in the prior embodiment. It should be further understood that in similarity to the above embodiment, the structure shown in FIG. 6 is operative by drawing handle sections 71 and 72 downwardly to cause the nipple member therein to extend upwardly through top 73 in the same operation as set forth above for the embodiment of FIGS. 1 through 5. Examination of base member discloses the sole operative difference between the alternate embodiment shown in FIG. 6 and the embodiment shown in FIGS. 1 through 5 in that base member 70 defines a trio of post recesses 63, 64 and 65 which extend downwardly therethrough and which receive a corresponding trio of catch posts 60 through 62 respectively. As is set forth below in FIG. 7, catch posts 60 through 62 cooperate with post recesses 63 through 65 respectively to replace and perform the closing functions of the tab and slot arrangements shown in the prior embodiment.

Accordingly and with reference to FIG. 7 which shows a section view of catch post 62 within post recess 65, top 73 is shown in preparation for mating to and attachment to base member 70. As can be seen, base 70 defines an inwardly extending boss 85 which in turn defines a post recess 65. An inwardly extending projection 80 is formed in the wall portion of post recess 65. Catch post 62 defines a lip 75. As can be seen, lip 75 is positioned and configured to cooperate with projection 80 to secure catch post 72 within post recess 65. Top 73 further defines a nesting rim 82 and an accordian wall 74. Base 70 defines a nesting recess 83 positioned and configured to receive nesting rim 82 such that the combination of catch post 62 and nesting rim 82 are received respectively within post recess 65 and nesting recess 83 to properly position top 73 with respect to base 70. In the position shown, accordian wall 74 is in contact with edge 81 of base 70 and thus completes closure of the cavity formed by top 73 and base 70. In addition, the position of top 73 and base 70 shown in FIG. 7 comprises the position resulting prior to the locking of post 62 within post recess 65 to complete the assembly of top 73 to base 70. The assembly is completed by forcing top 73 downwardly against base 70 and thereby causing catch post 62 to move downwardly within post recess 65 until lip 75 passes across and is brought into contact with projection 80. When so positioned, lip 75 and projection 80 cooperate to secure catch post 62 within recess 65. In addition, the nesting of nesting rim 82 within nesting recess 83 further assists in the positive positioning of top 73 with respect to base 70.

It should be understood that while FIG. 7 shows the structure of catch post 62 and post recess 65 in detail, they are also exemplary of the structures formed by catch posts 60 and 61 and post recesses 63 and 64 respectively.

What has been shown is an improved baby pacifier which provides for configuration in a closed position in which the nipple member is completely protected and thereby remains free of contamination. The inventive pacifier shown is alternatively configured into an open position in which the pacifiers nipple member is exposed for use by the baby in the normal manner.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A baby pacifier comprising:
   - a domed base member defining an interior concave surface, and a pair of slots;
   - a nipple member having an elongated nipple stem joined to and extending from said interior surface and a generally rounded nipple end;
   - means attaching said base member to said top member to enclose said nipple member; and
   - handle means for collapsing said top member against said base member and exposing said nipple member through said elongated slot, said handle means include a pair of arms extending through said pair of slots and joined to said top member.

2. A baby pacifier as set forth in claim 1 wherein said top defines a collapsible wall portion joined to said base member.

3. A baby pacifier as set forth in claim 2 wherein said base member defines a plurality of outwardly extending tabs and said collapsible wall portion defines a corresponding plurality of slots through which said plurality tabs extend.

4. A baby pacifier as set forth in claim 3 wherein said handle means includes a pair of annular ring portions joined to said arms.

5. A baby pacifier as set forth in claim 4 wherein said pair of annular rings are configured to be snap-fitted together.

6. A baby pacifier as set forth in claim 5 wherein said domed base member is formed of a resilient material.

7. A baby pacifier as set forth in claim 2, wherein said top member defines a corresponding plurality of catch posts which extend into said post recesses and are lockably received therein.

* * * * *